US008424671B2

(12) United States Patent
Tokuda et al.

(10) Patent No.: US 8,424,671 B2
(45) Date of Patent: Apr. 23, 2013

(54) ARTICLE TRANSFER APPARATUS

(75) Inventors: Fumitaka Tokuda, Shiga (JP); Satoshi Nishitsuji, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 22 days.

(21) Appl. No.: 13/323,051

(22) Filed: Dec. 12, 2011

(65) Prior Publication Data

US 2012/0145516 A1 Jun. 14, 2012

(30) Foreign Application Priority Data

Dec. 14, 2010 (JP) ..... 2010-277728
Jan. 19, 2011 (JP) ..... 2011-009167

(51) Int. Cl.
*B65G 47/20* (2006.01)

(52) U.S. Cl.
USPC ..... 198/533; 193/2 R; 222/203

(58) Field of Classification Search ..... 198/533, 198/550.2; 193/2 R, 4, 25 R; 222/199, 202, 222/203, 238, 239; 221/183, 203, 222, 237
See application file for complete search history.

(56) References Cited

U.S. PATENT DOCUMENTS

| | | | | |
|---|---|---|---|---|
| 2,732,099 | A * | 1/1956 | Davis | 222/203 |
| 3,346,917 | A * | 10/1967 | Lennox | 222/203 |
| 3,525,445 | A * | 8/1970 | Barger | 222/203 |
| 4,623,098 | A * | 11/1986 | Motoyama et al. | 241/46.04 |
| 5,160,016 | A * | 11/1992 | Moksnes | 198/533 |
| 5,921,369 | A * | 7/1999 | Steele | 193/25 R |
| 6,823,904 | B2 * | 11/2004 | Finke et al. | 222/203 |
| 6,889,874 | B2 * | 5/2005 | Vohwinkel | 222/203 |

FOREIGN PATENT DOCUMENTS

JP 11-49104 A 2/1999

* cited by examiner

*Primary Examiner* — James R Bidwell
(74) *Attorney, Agent, or Firm* — Global IP Counselors, LLP

(57) ABSTRACT

An article transfer apparatus transfers articles downward into packaging. The article transfer apparatus includes a cylindrical chute that extends in a vertical direction. Slits are formed in a side wall surface of the chute. A clogging prevention member is rotatably supported adjacent to the chute. The clogging prevention member is configured and arranged to periodically enter the chute through the slit from an exterior of the chute while the clogging prevention member is rotating.

14 Claims, 13 Drawing Sheets

ARTICLE TRANSFER APPARATUS

TECHNICAL FIELD

The present invention relates to an article transfer apparatus for transferring articles downward which fall from above.

BACKGROUND ART

In conventional practice, there are known packaging apparatuses in which a belt-shaped film is formed into a cylindrical shape while being transferred downward, the bottom end of this cylindrical film is sealed, articles are dropped into the cylindrical film, and the top end of the cylindrical film is then sealed, thereby forming a packaged bag.

In such a packaging apparatus, when articles are dropped via a chute into the cylindrical film which has been sealed at the bottom end, the articles sometimes become clogged in the chute depending on the size of the articles, their shape, their weight, and the diameter of the chute. In view of this, there has been proposed a packaging apparatus comprising a pressing member for forcing articles clogged in the chute to fall into the bag, as shown in Japanese Laid-open Patent Application No. 11-49104, for example. The article-pressing member in this packaging apparatus protrudes into the chute by shaking and causes articles clogged within the chute to fall into the packaged bag.

SUMMARY OF THE INVENTION

Technical Problem

However, in the packaging apparatus described above, since articles clogged within the chute are forcefully pressed in by the pressing member, there have been problems with the articles breaking and with damaged articles being filled into packaged bags.

In view of this, an object of the present invention is to provide an article transfer apparatus capable of preventing the articles from being damaged while preventing the articles from becoming clogged within the chute.

Solution to Problem (1)

An article transfer apparatus according to the present invention is an article transfer apparatus for transferring articles downward which fall from above, comprising a cylindrical chute extending vertically, a slit formed in a side wall surface of the chute, and a clogging prevention member. The clogging prevention member, which is rotatably supported, enters the chute through the slit from the exterior while rotating.

The clogging prevention member herein periodically enters into the chute as it rotates. Articles are transferred by the rotating clogging prevention member, and clogging of the articles inside the chute can therefore be inhibited.

Due to the clogging prevention member entering into the chute, the size of the effective cross-sectional area, the cross-sectional shape, and the center position of the cross section of the chute interior all change, and clogging caused by the articles can be effectively inhibited.

When the rotational direction of the clogging prevention member inside the chute is the same direction as the falling direction of the articles, there is a small probability of the articles being damaged even if the falling articles and the clogging prevention member come in contact.

(2)

In the article transfer apparatus according to the present invention, a plurality of the clogging prevention members are provided, and the clogging prevention members can be made to enter the chute with different timings (staggered intervals).

In this case, since the clogging prevention members enter into the chute with different timings, it is possible to inhibit extreme decreases in the effective cross-sectional area of the chute interior. As a result, compression and damage of the articles can be inhibited in the chute interior.

When the clogging prevention members enter into the chute with different timings, the size of the effective cross-sectional area, the cross-sectional shape, and the center position of the cross section of the chute interior all change diversely, and clogging caused by the articles can be effectively inhibited. Particularly when the inside diameter of the chute is small, it is possible to inhibit decreases in the space through which articles pass by having the clogging prevention members enter into the chute at different timings.

(3)

In the article transfer apparatus according to the present invention, the clogging prevention members can be disposed at equal intervals in the periphery of the chute and made to rotate with a phase difference of equal intervals.

In this case, since the clogging prevention members rotate at predetermined phase differences from each other, vibration caused by the rotation of the clogging prevention members can be cancelled. Vibration in the article transfer apparatus can thereby be reduced.

(4)

In the article transfer apparatus according to the present invention, a plurality of the clogging prevention members are provided in the periphery of the chute, and the clogging prevention members can be made to enter the chute with the same timing (simultaneously).

In this case, since the clogging prevention members enter into the chute at the same time, the inside diameter of the chute intermittently increases and decreases. The articles can be reliably fed downward by this increasing and decreasing of the inside diameter of the chute. Particularly, even if the clogging prevention members enter into the chute at the same time, in an article transfer apparatus having a chute whose inside diameter is large enough to ensure a space through which articles can pass, increasing and decreasing the inside diameter of the chute as described above is extremely effective in terms of inhibiting clogging caused by the articles.

(5)

In the article transfer apparatus according to the present invention, the clogging prevention members preferably each have a circular plate part and a protruding part which protrudes radially outward from the external periphery of the circular plate part. The protruding part is a portion which enters into the chute through the slit from the outer side of the chute along with the rotation of the clogging prevention member.

In the case of such a configuration, the effective cross-sectional area, the cross-sectional shape, and the center position of the cross section of the chute interior can be changed as desired by rotating the clogging prevention members which have this special contour shape. As a result, clogging of the articles can be effectively inhibited.

(6)

In the article transfer apparatus according to the present invention, the amount by which the protruding part protrudes radially outward from the circular plate part preferably increases further in the direction opposite the direction in which each of the clogging prevention members rotates.

In the case of such a configuration, when the protruding part of a clogging prevention member enters into the chute, the amount by which the protruding part protrudes into the chute gradually increases along with the rotation of the clogging prevention member. The articles can thereby be inhibited from being knocked off by the protruding part.

(7)

In the article transfer apparatus according to the present invention, each of the clogging prevention members preferably has a plurality of protruding parts. The protruding parts are formed at predetermined intervals along the circumferential direction of the circular plate part.

In the case of such a configuration, the protruding parts continually enter into the chute during a single rotation of the clogging prevention member. It is thereby possible, in a high-speed article transfer apparatus which causes articles to fall continuously, to continuously cause a protruding part to enter into the chute every time an article falls. As a result, in an article transfer apparatus which transfers articles at a high speed, it is possible to inhibit the articles from becoming clogged in the chute interior.

(8)

In the article transfer apparatus according to the present invention, each of the clogging prevention members is preferably either a plate-shaped member having a thickness substantially equal to the width of the slit, or a plate-shaped member having a thickness less than the width of the slit.

When each of the clogging prevention members is a plate-shaped member having a thickness substantially equal to the width of the slit, the slit can be closed off across the width direction by the clogging prevention member entering into the chute. It is thereby possible to inhibit articles from spilling out of the chute interior. Similarly, it is still possible to inhibit articles from spilling out of the chute interior when each of the clogging prevention members is a plate-shaped member having a thickness less than the width of the slit.

(9)

The article transfer apparatus of the present invention preferably further comprises a controller for controlling the rotation of the clogging prevention members so as to reach a rotation rate determined based on the falling velocity of the articles in the position where the inside diameter of the chute reaches a minimum.

When such a controller is included, the circumferential speed of the clogging prevention members can be made to nearly match the falling speed of the articles in the chute interior, and damage to the articles due to contact between the articles and the clogging prevention members can be further inhibited.

DESCRIPTION OF EMBODIMENTS

Figure 1:
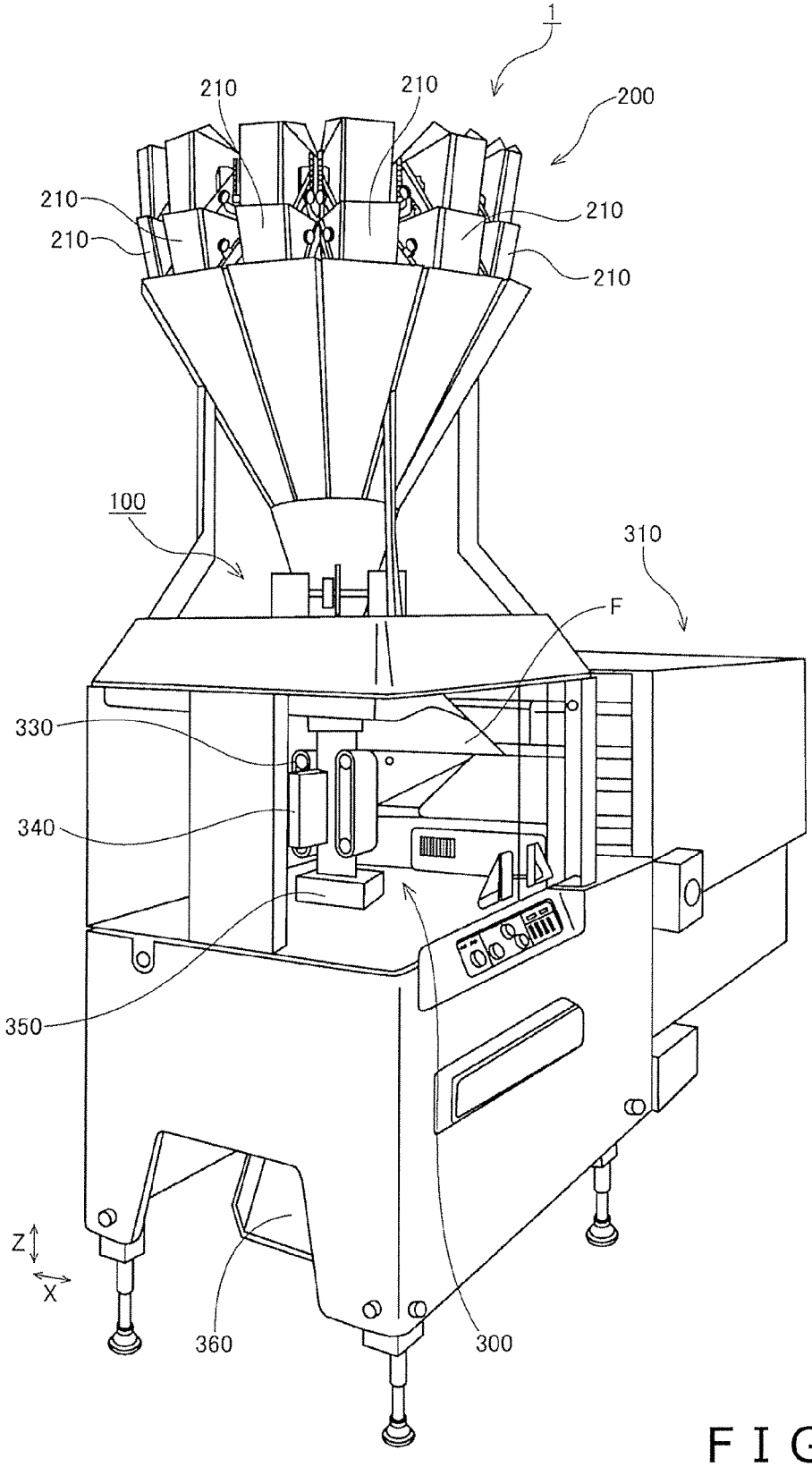
FIG. 1 is a perspective view showing the overall configuration of a system comprising the article transfer apparatus according to the first embodiment of the present invention.

The article transfer apparatus according to the embodiments of the present invention are described hereinbelow while referring to the drawings.

First Embodiment

Overall Configuration of Article Transfer Apparatus

Figure 2:
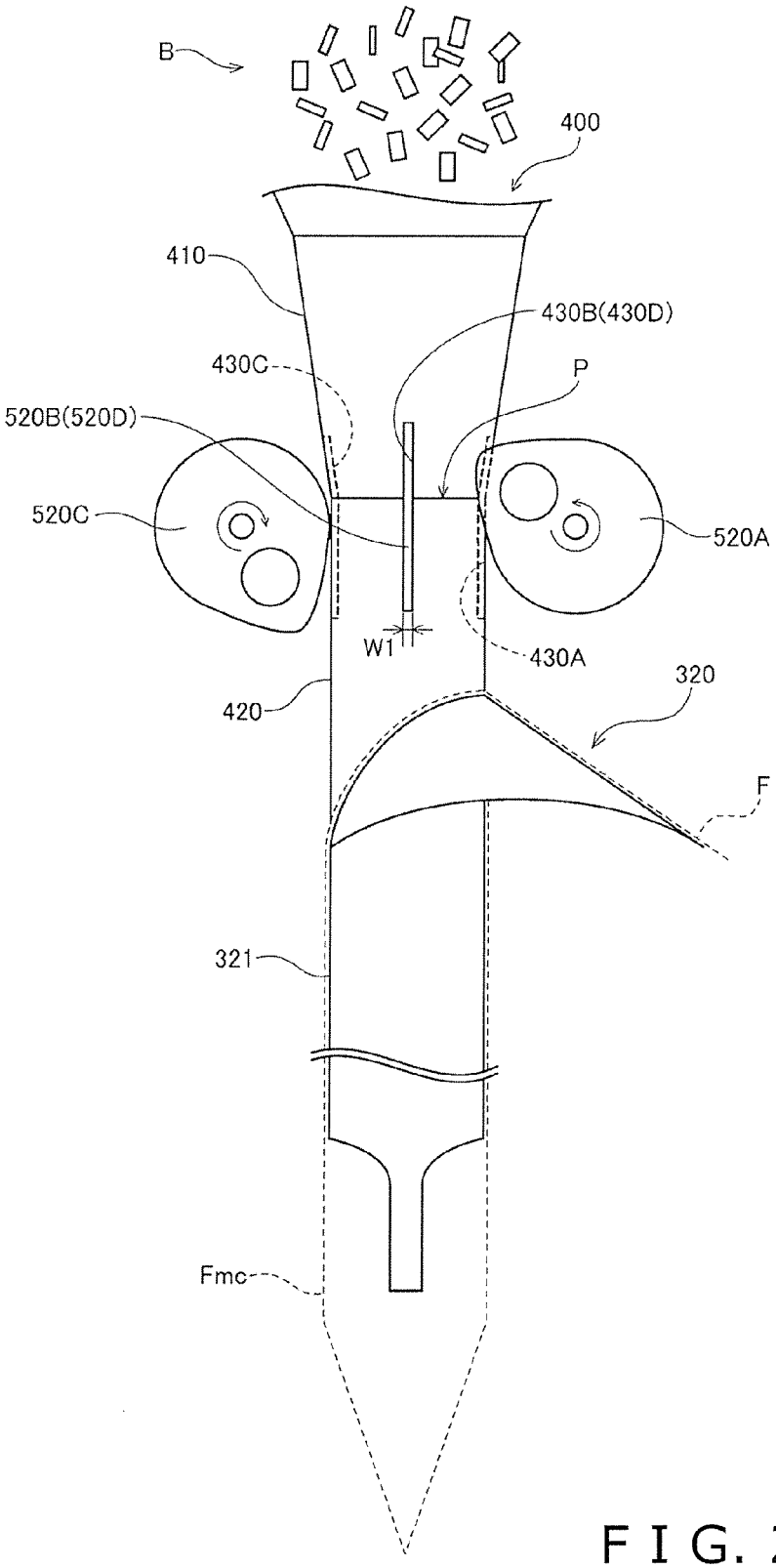
FIG. 2 is a side view of the article transfer apparatus and the packaging apparatus according to the first embodiment.

An article transfer apparatus 100 according to the first embodiment is an apparatus in which articles B (e.g. potato chips or another snack foods), having been weighted and metered to predetermined weights (e.g. 55 g) by a combining and metering apparatus 200 disposed above the article transfer apparatus 100, are transferred downward, and the articles B are filled into a cylindrical film Fmc formed by a packaging apparatus 300 disposed below the article transfer apparatus 100, as shown in FIGS. 1 and 2. One hundred or more products are manufactured per minute in the system 1 configured from the combining and metering apparatus 200, the article transfer apparatus 100, and the packaging apparatus 300.

<Combining and Metering Apparatus>

The combining and metering apparatus 200 disposed on the upstream side of the article transfer apparatus 100 is an apparatus which meters the weight of the articles B accommodated in a plurality of (e.g. fourteen) hoppers 210, and then combines the articles so that the metered values reach a predetermined total weight and sequentially expels the articles, as shown in FIG. 1. Having reached the total weight, the articles B are dropped into a collecting chute 400 of the article transfer apparatus 100 as shown in FIG. 2.

<Packaging Apparatus>

The packaging apparatus 300 disposed on the downstream side of the article transfer apparatus 100 is an apparatus which continuously creates bagged products, by filling articles B and sealing them in the cylindrical film Fmc by a process of forming a belt-shaped film F into a bag form, as shown in FIGS. 1 and 2. To inhibit corrosion and/or oxidation in the cylindrical film Fmc, nitrogen gas, argon gas, or another inert gas is sealed in the film. The packaging apparatus 300 primarily has a film supplier 310 for supplying the belt-shaped film F, a former 320 for forming a cylindrical shape out of the film F being fed in a belt shape, a pull-down belt mechanism 330 for conveying the cylindrical film Fmc downward, a vertical sealing mechanism 340 for vertically sealing the overlapping portions of the cylindrical film Fmc, a horizontal sealing mechanism 350 for horizontally sealing the cylindrical film Fmc, and an expelling chute 360 for expelling the products.

<Article Transfer Apparatus>

The article transfer apparatus 100 of the present embodiment is an apparatus in which articles B dropped from the combining and metering apparatus 200 disposed upstream of the article transfer apparatus 100 are collected and transferred downward, and the articles B are filled into the packaging apparatus 300 disposed downstream of the article transfer apparatus 100. This article transfer apparatus 100 comprises the collecting chute 400 for collecting articles B dropped from the combining and metering apparatus 200, and cam plate unit 500 in which first through fourth cam plates 520A to 520D are inserted into the collecting chute 400 so that the articles B do not become clogged in the collecting chute 400.

<Collecting Chute>

The collecting chute 400 is a cylindrical member as shown in FIG. 2, and the articles B dropped from the plurality of hoppers 210 of the combining and metering apparatus 200 slide down the inside wall surface of the collecting chute 400. This collecting chute 400 has a narrowing portion 410 in which the inside diameter decreases from the top to the bottom, and a straight portion 420 extending downward from the bottom end of the narrowing portion 410. This straight portion 420 is a straight tube having a substantially uniform diameter. The straight portion 420 is connected to a tube 321 (see FIG. 2) which fulfills the role of conveying the cylindrical film Fmc vertically downward. The tube 321 is a member constituting the aforementioned former 320 of the packaging apparatus 300.

Figure 3:
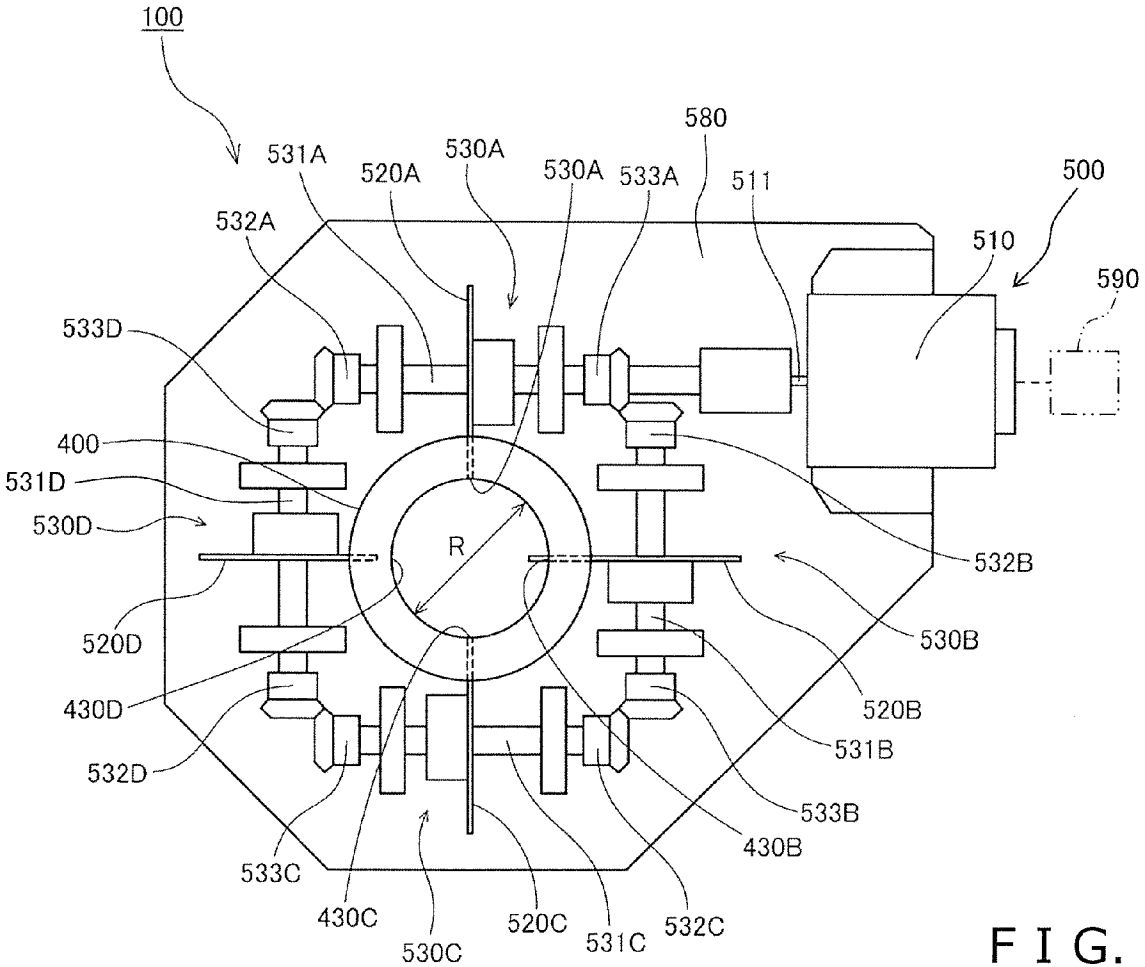
FIG. 3 is a plan view of the cam plate unit according to the first embodiment.

In the present embodiment, four slits 430A to 430D are provided at 90° intervals in a plan view in the side wall of the collecting chute 400, as shown in FIGS. 2 and 3. These slits 430A to 430D fulfill the role of allowing the first through fourth cam plates 520A to 520D, described hereinafter, to be inserted into the collecting chute 400. The slits 430A to 430D are formed along the up-down direction (the direction of arrow Z). The width W1 of each slit 430A to 430D is 3 mm. In the present embodiment, the slits 430A to 430D are formed in a position P which is a connecting position between the narrowing portion 410 and the straight portion 420. In other words, the position P can be referred to as the bottom end position of the narrowing portion 410, or the top end position of the straight portion 420. This position P is a position where the angle of inclination changes in the inside wall surface of the collecting chute 400, and is one location where the falling articles B easily become clogged. The top end of the narrowing portion 410 is provided with a dropping hole into which the articles B are dropped, and the diameter of this hole is 1000 to 1500 mm. The inside diameter R (see FIG. 3) of the straight portion 420 is the minimum inside diameter in the collecting chute 400, and this diameter is 80 to 200 mm.

<Cam Plate Unit>

As shown in FIG. 3, the cam plate unit 500 is designed so that the four first through fourth cam plates 520A to 520D periodically extend into and then retract out of the collecting chute 400 at predetermined intervals, thereby ensuring that articles B falling from above do not become clogged inside the collecting chute 400.

This cam plate unit 500 has a motor 510 as a drive source, the four first through fourth cam plates 520A to 520D (hereinbelow referred to appropriately as the first cam plate 520A, the second cam plate 520B, the third cam plate 520C, and the fourth cam plate 520D), and four drive parts 530A to 530D (hereinbelow referred to appropriately as the first drive part 530A, the second drive part 530B, the third drive part 530C, and the fourth drive part 530D) for rotating the first through fourth cam plates 520A to 520D, as shown in FIG. 3.

<Cam Plates>

The four first through fourth cam plates 520A to 520D as clogging prevention members are each rotatably supported around a horizontal axis. As seen in a plan view in FIG. 3, these four first through fourth cam plates 520A to 520D are disposed at equal 90° intervals around the collecting chute 400. In the present embodiment, the first through fourth cam plates 520A to 520D are provided to the position P described above. In the present embodiment, the four first through fourth cam plates 520A to 520D are configured so as to rotate at phases different from each other by 90°. The details of the actions of the four first through fourth cam plates 520A to 520D are described below. The first through fourth cam plates 520A to 520D are provided to the position P here, but in cases in which the straight portion 420 has a part whose inside diameter decreases, the first through fourth cam plates 520A to 520D can be provided to locations where the inside diameter is decreasing.

Figure 4A:
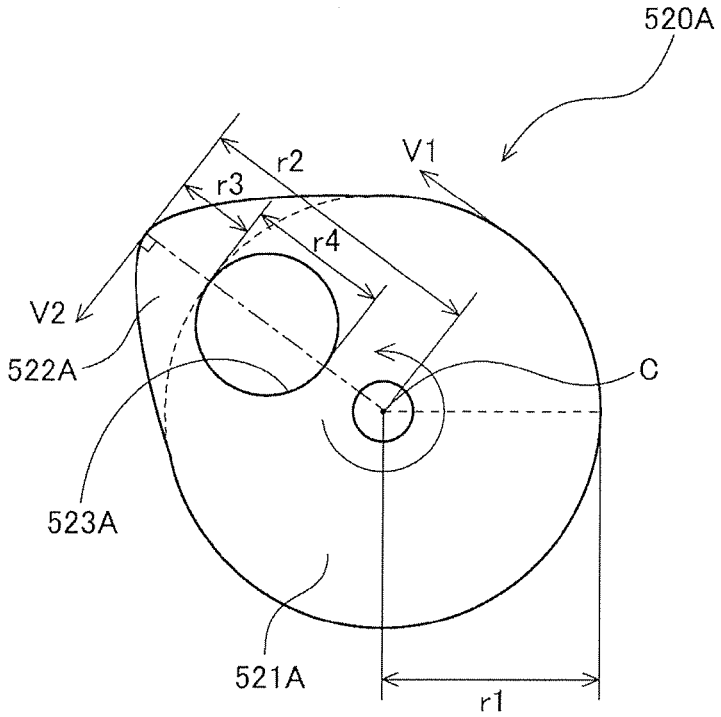
FIG. 4 is a side view of the cam plate according to the first embodiment.
Figure 4B:
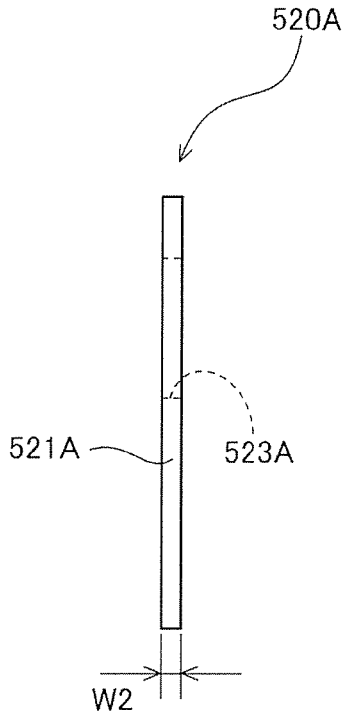

The first cam plate 520A has a base disc part 521A having a substantially circular plate shape, and a protruding part 522A extending outward in the radial direction from the external periphery of the base disc part 521A, as shown in FIG. 4. A through-hole 523A is formed in the first cam plate 520A. This through-hole 523A is formed between the rotational center C and the protruding part 522A. By forming the through-hole 523A in this area, the barycenter, which is shifted away from the rotational center C toward the protruding part 522A due to the presence of the protruding part 522A, can be brought nearer to the rotational center C. The configurations of the second through fourth cam plates 520B to 520D are not described because they are identical to the configuration of the first cam plate 520A described above.

In the present embodiment, the plate width W2 of the first through fourth cam plates 520A to 520D is substantially the same as the width W1 of each of the slits 430A to 430D as shown in FIG. 4, and the size thereof is 2 mm. The radius r1 of the base disc part 521A is 45 mm, and the dimension r2 from the rotational center C to the distal end of the protruding part 522A is 60 mm. The dimension r3 from the distal end of the protruding part 522A to the through-hole 523A is 15 mm. The diameter r4 of the through-hole 523A is 30 mm.

<Motor>

The motor 510 functions as a drive source for rotating the four first through fourth cam plates 520A to 520D. Specifically, in the present embodiment, the four first through fourth cam plates 520A to 520D are rotated by a single motor 510. This motor 510 has a drive shaft 511 which rotates around a horizontal axis as shown in FIG. 3. In the present embodiment, the rotational speed of the motor 510 is 955 rpm. This rotational speed of the motor 510 is established by the radius r1 (45 mm in the present embodiment) of the base disc part 521A of the first through fourth cam plates 520A to 520D, described hereinafter. The circumferential velocity V1 of the base disc part 521A is calculated by the following formula (1).

$$V1=2\pi nR \quad (1)$$

This circumferential velocity V1 of the base disc part 521A resembles the falling velocity of articles B in position P of the collecting chute 400.

Specifically, when the rotational speed (955 [rpm]) in the present embodiment is substituted for n of formula (1) and the radius r1 (45 [mm]) of the base disc part 521A in the present embodiment is substituted for R of formula (1), the circumferential velocity V1 is 269883 [mm/min]. When the unit [mm/min] is converted to [m/s], the circumferential velocity V1 is approximately 4.5 [m/s]. This circumferential velocity V1 (approximately 4.5 [m/s]) resembles the falling velocity of articles B in position P of the collecting chute 400. Specifically, the rotational speed (955 [rpm]) of the motor 510 is established so that the circumferential velocity V1 of the base disc part 521A resembles the falling velocity of articles B in position P of the collecting chute 400. This is established by a controller 590 (see FIG. 3) for performing drive control on the motor 510, on the basis of information or manually inputted data from the combining and metering apparatus 200.

Due to the circumferential velocity V1 of the base disc part 521A resembling the falling velocity of the articles B in position P as described above, the circumferential velocity V2 of the protruding part 522A provided farther radially outward than the base disc part 521A is greater than the falling velocity (approximately 4.5 [m/s]).

<Drive Parts>

The first drive part 530A has, as shown in FIG. 3, a first shaft 531A attached to the drive shaft 511 of the motor 510, a first bevel gear 532A attached to one end of the shaft 531A, and a second bevel gear 533A attached to the other end of the first shaft 531A.

The second drive part 530B has, in a plan view, a second shaft 531B disposed so as to be orthogonal to the first shaft 531A, a third bevel gear 532B attached to one end of the second shaft 531B, and a fourth bevel gear 533B attached to the other end of the second shaft 531B.

The third drive part 530C has, in a plan view, a third shaft 531C disposed so as to be orthogonal to the second shaft 531B, a fifth bevel gear 532C attached to one end of the third shaft 531C, and a sixth bevel gear 533C attached to the other end of the third shaft 531C. The first shaft 531A of the first drive part 530A and the third shaft 531C of the third drive part 530C are disposed in parallel.

The fourth drive part 530D has, in a plan view, a fourth shaft 531D disposed so as to be orthogonal to the third shaft 531C, a seventh bevel gear 532D attached to one end of the fourth shaft 531D, and an eighth bevel gear 533D attached to the other end of the fourth shaft 531D. The fourth shaft 531D of the fourth drive part 530D and the second shaft 531B of the second drive part 530B, are disposed in parallel.

The shafts 531A, 531B, 531C, and 531D are supported by bearings fixed to a base 580 which supports the motor 510.

The second bevel gear 533A of the first drive part 530A meshes with the third bevel gear 532B of the second drive part 530B. The fourth bevel gear 533B of the second drive part 530B meshes with the fifth bevel gear 532C of the third drive part 530C. The sixth bevel gear 533C of the third drive part 530C meshes with the seventh bevel gear 532D of the fourth drive part 530D. The eighth bevel gear 533D of the fourth drive part 530D meshes with the first bevel gear 532A of the first drive part 530A. The drive force of the motor 510 is thereby transmitted to the first through fourth shafts 531A to 531D, and the first through fourth cam plates 520A to 520D are caused to rotate.

<Rotation of the Four Cam Plates>

Figure 5:
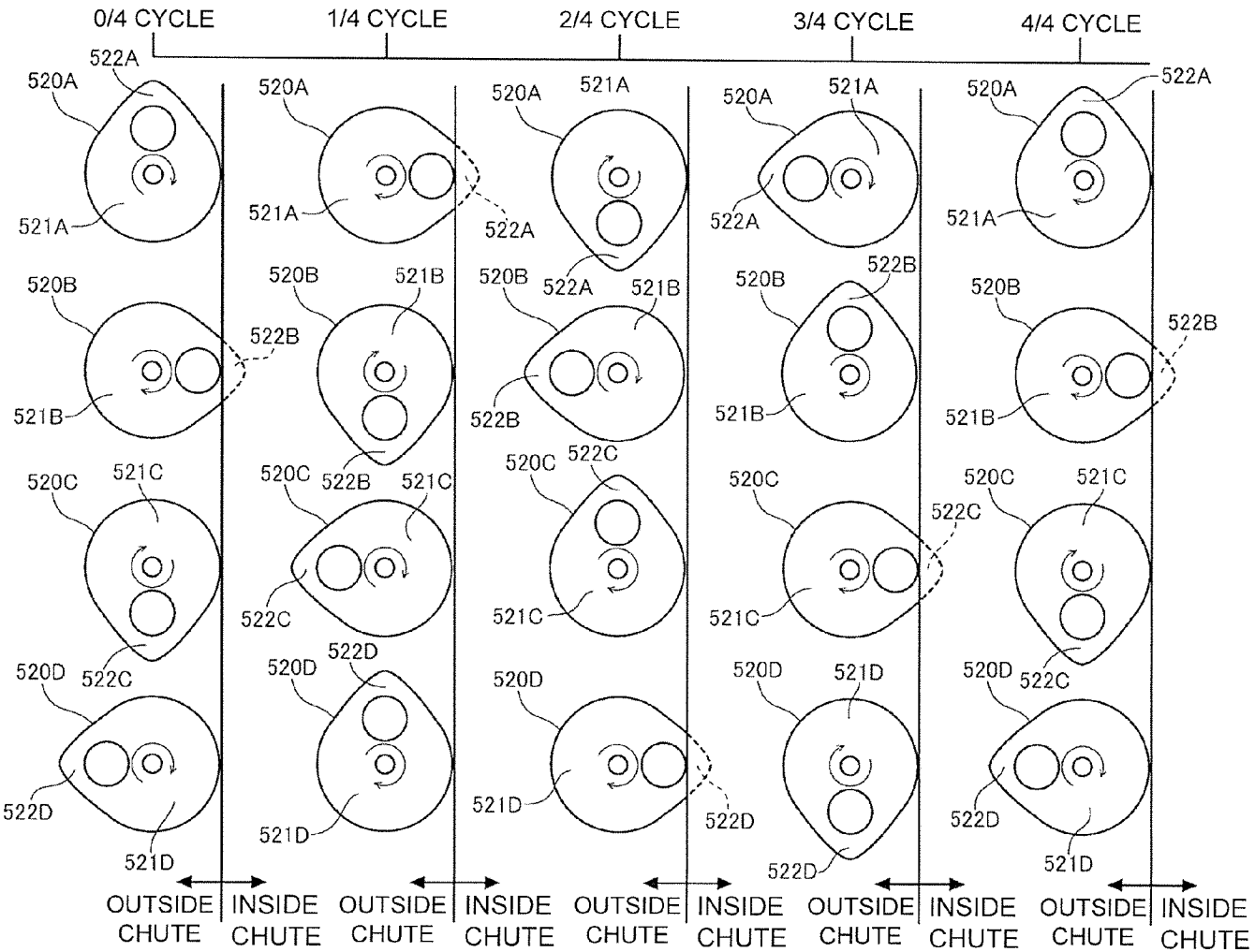
FIG. 5 is a drawing for describing the rotation of the four cam plates according to the first embodiment.

The rotation of the four first through fourth cam plates 520A to 520D is described with reference to FIG. 5. In the present embodiment, the four cam plates are disposed (located) at 90° intervals around the periphery of the collecting chute, and these four cam plates rotate at 90°, 180° or 270° phase differences relative to one another. In FIG. 5, time needed for the first through fourth cam plates 520A to 520D to make a full rotation is designated as one cycle, and the states of 0/4 cycle, 1/4 cycle, 2/4 cycle, 3/4 cycle, and 4/4 cycle (identical to 0/4 cycle) are shown.

First, at 0/4 cycle, the first cam plate 520A is disposed so that the protruding part 522A thereof faces upward. The second cam plate 520B, which is adjacent to the first cam plate 520A, is rotated 90° relative to the first cam plate 520A, and the protruding part 522B thereof enters into the collecting chute 400. The third cam plate 520C, which is adjacent to the second cam plate 520B and disposed facing the first cam plate 520A, is rotated 180° relative to the first cam plate 520A, and the protruding part 522C thereof is disposed facing downward. The fourth cam plate 520D, which is adjacent to the third cam plate 520C and disposed facing the second cam plate 520B, is rotated 270° relative to the first cam plate 520A, and the protruding part 522D thereof is disposed facing away from the collecting chute 400.

At 1/4 cycle, the first cam plate 520A has rotated 90°, and the protruding part 522A thereof has entered into the collecting chute 400. The second cam plate 520B has also rotated 90° and is disposed so that the protruding part 522B thereof faces downward. The third cam plate 520C has also rotated 90° and is disposed so that the protruding part 522C thereof faces away from the collecting chute 400. The fourth cam plate 520D has also rotated 90° and is disposed so that the protruding part 522D thereof faces upward.

At 2/4 cycle, the first cam plate 520A has further rotated 90° and is disposed so that the protruding part 522A faces downward. The second cam plate 520B has also further rotated 90° and is disposed so that the protruding part 522B faces away from the collecting chute 400. The third cam plate 520C has also further rotated 90° and is disposed so that the protruding part 522C faces upward. The fourth cam plate 520D has also further rotated 90° and the protruding part 522D has entered into the collecting chute 400.

At 3/4 cycle, the first cam plate 520A has further rotated 90° and is disposed so that the protruding part 522A faces away from the collecting chute 400. The second cam plate 520B has also further rotated 90° and is disposed so that the protruding part 522B faces upward. The third cam plate 520C has also further rotated 90° and the protruding part 522C has entered into the collecting chute 400. The fourth cam plate 520D has also further rotated 90° and is disposed so that the protruding part 522D faces downward.

At 4/4 cycle, the first through fourth cam plates 520A to 520D each further rotate 90° and return to the same state as 0/4 cycle.

As described above, the four first through fourth cam plates 520A to 520D sequentially enter into the collecting chute 400 within one cycle. At 0/4 cycle, the second cam plate 520B enters into the collecting chute 400, at 1/4 cycle, the first cam plate 520A enters into the collecting chute 400, at 2/4 cycle, the fourth cam plate 520D enters into the collecting chute 400, and at 3/4 cycle, the third cam plate 520C enters into the collecting chute 400.

Effects in Present Embodiment

In the article transfer apparatus 100 according to the first embodiment, the first through fourth cam plates 520A to 520D rotate and enter into the collecting chute 400, whereby the first through fourth cam plates 520A to 520D facilitate transferring of the articles B, and the articles B are therefore inhibited from becoming clogged within the collecting chute 400.

Particularly, in the article transfer apparatus 100 of the present embodiment, since the circumferential velocities V1 of the base disc parts 521A to 521D of the first through fourth cam plates 520A to 520D resemble the falling velocity of the articles B inside the collecting chute 400, the articles B are inhibited from being damaged by the contact between the articles B and the first through fourth cam plates 520A to 520D.

In the article transfer apparatus 100 of the present embodiment, the articles B are inhibited from becoming clogged at position P due to the first through fourth cam plates 520A to 520D entering into the collecting chute 400 at position P which is one location where articles B readily become clogged.

In the article transfer apparatus 100 of the present embodiment, the size of the effective cross-sectional area of the interior of the collecting chute 400 changes due to the first through fourth cam plates 520A to 520D entering into the collecting chute 400. Specifically, the effective cross-sectional area of the interior of the collecting chute 400, repeatedly increases and decreases. Clogging of the articles B is thereby effectively inhibited.

In the article transfer apparatus 100 of the present embodiment, the cross-sectional shape of the interior of the collecting chute 400 changes due to the first through fourth cam plates 520A to 520D entering into the collecting chute 400. The area through which the articles B pass thereby changes over time. Clogging of the articles B is thereby effectively inhibited.

In the article transfer apparatus 100 of the present embodiment, the center position of the cross section of the interior of the collecting chute 400 changes due to the first through fourth cam plates 520A to 520D entering into the collecting chute 400. The center where groups of articles (clusters of articles B) tend to collect thereby changes over time. Clogging of the articles B is thereby effectively inhibited.

In the article transfer apparatus 100 of the present embodiment, within the collecting chute 400, since the rotational direction of the first through fourth cam plates 520A to 520D and the falling direction of the articles B (the direction of arrow Z) both lead from the top to the bottom, the articles B can be inhibited from being damaged even though the falling articles B and the first through fourth cam plates 520A to 520D come in contact. There are therefore fewer small pieces of broken articles that get accommodated in the cylindrical film Fmc.

In the article transfer apparatus 100 of the present embodiment, since the first through fourth cam plates 520A to 520D enter into the collecting chute 400 with different timings (i.e., staggered intervals with a phase differences of (90°), the effective cross-sectional area of the interior of the collecting chute 400 is inhibited from becoming extremely small. As a result, the articles B are inhibited from being compressed and damaged within the collecting chute 400. The term "effective cross-sectional area" used above refers to the horizontal cross-sectional area of the space through which the articles can pass.

In the article transfer apparatus 100 of the present embodiment, due to the first through fourth cam plates 520A to 520D entering into the collecting chute 400 with different timings, the effective cross-sectional area, the cross-sectional shape, and the cross-sectional center position of the interior of the collecting chute 400 all diversely change, and clogging of the articles B is thereby effectively inhibited.

In the article transfer apparatus 100 of the present embodiment, the four first through fourth cam plates 520A to 520D are disposed at 90° intervals around the periphery of the collecting chute 400 and are made to rotate at 90° phase differences of each other, and vibration caused by the rotation of the first through fourth cam plates 520A to 520D can be canceled. Vibration in the article transfer apparatus 100 can thereby be reduced.

In the article transfer apparatus 100 of the present embodiment, the effective cross-sectional area, the cross-sectional shape, and the cross-sectional center position of the interior of the collecting chute 400 can be varied as desired, by rotating the first through fourth cam plates 520A to 520D which have the special contour shape as shown in FIG. 4. As a result, clogging of the articles B is effectively inhibited.

In the article transfer apparatus 100 of the present embodiment, the four first through fourth cam plates 520A to 520D sequentially enter into the collecting chute 400. When there are five or more cam plates and the intervals at which the cam plates enter the collecting chute 400 are distributed equally, a plurality of cam plates will enter into the collecting chute, and the effective cross-sectional area of the interior of the collecting chute decreases over a longer period of time. As a result, there is a risk of causing the opposite effect of articles clogging inside the collecting chute.

Having four cam plates as in the article transfer apparatus 100 of the present embodiment, rather than three or five, makes the mechanical configuration simpler, and costs can be minimized.

In the article transfer apparatus 100 of the present embodiment, since the plate thickness of each of the first through fourth cam plates 520A to 520D and the width of each of the slits 430A to 430D are substantially equal, the slits 430A to 430D can be closed off throughout their width direction (the normal direction of the collecting chute 400 in the positions where the slits 430A to 430D are formed) by the first through fourth cam plates 520A to 520D entering into the collecting chute 400. The articles B are thereby inhibited from spilling out of the interior of the collecting chute 400.

In the article transfer apparatus 100 of the present embodiment, the falling articles B can be slightly accelerated by the rotating first through fourth cam plates 520A to 520D coming in contact with the falling articles B. Particularly, in the present embodiment, the circumferential velocities V1 of the base disc parts 521A to 521D are made to resemble the falling velocity of the articles B within the collecting chute 400, whereby the circumferential velocities V2 of the protruding parts 522A to 522D of the first through fourth cam plates 520A to 520D are greater than the falling velocity of the articles B. The falling articles B can thereby be slightly accelerated by the first through fourth cam plates 520A to 520D moving from up to down.

WORKING EXAMPLES

Clogging Proportion Verification Test

The following is a description of a test performed in order to confirm the technological effects (inhibiting clogging caused by the articles) of the article transfer apparatus 100 according to the embodiment described above. In this test, as Working Examples 1 and 2, an inspection was performed of the clogging proportion of articles transferred by the article transfer apparatus (the apparatus including the cam plate unit 500) 100 described above. As Comparative Example 1, an inspection was performed of the clogging rate of articles transferred by an article transfer apparatus having no cam plate unit. Aside from the cam plate unit 500, the article transfer apparatus according to the comparative example is identical to the article transfer apparatus according to the working examples.

In Working Examples 1 and 2 and Comparative Example 1, articles were dropped from the combining and metering apparatus 200 to the article transfer apparatus 100 with 56.6 g as the target weight. The articles used here were chips having substantially regular triangle shapes, the length of sides of which were approximately 70 mm, and the thickness of which was approximately 1.5 mm. The minimum inside diameter of the collecting chute 400 in Working Examples 1 and 2 and Comparative Example 1 was approximately 140 mm.

(Evaluation Method)

In the following Working Example 1, Working Example 2, and Comparative Example 1, the number of times article clogging occurred was counted until the number of times the articles properly filled a package reached twenty. The readiness with which articles become clogged in the article transfer apparatus according to Working Example 1, Working Example 2, and Comparative Example 1 was evaluated by calculating the article clogging proportion by the following formula (2).

$$\text{Clogging proportion [\%]}=(\text{number of cloggings/number of tests performed})\times 100 \quad (2)$$

Working Example 1

In the article transfer apparatus 100 according to Working Example 1, the four cam plates 520A to 520D rotate at phase differences of 90° from each other. The rotational speed of each of these cam plates 520A to 520D is 1000 rpm. The dimensions of the cam plates are as shown in FIG. 4: r1 (radius of base disc part 521A)=45 mm, r2 (radius from rotational center C to distal end of protruding part 522A)=60 mm, r3 (length from distal end of protruding part 522A to through-hole 523A)=15 mm, r4 (diameter of through-hole 523A)=30 mm.

In Working Example 1, articles filled the packages properly twenty continuous times without the articles clogging. Specifically, the article clogging proportion in Working Example 1 was 0% ((0/20)×100) according to the above formula (2).

Working Example 2

In the article transfer apparatus 100 according to Working Example 2, the four cam plates 520A to 520D rotate at phase differences of 90° from each other. The rotational speed of each of the cam plates 520A to 520D is 1700 rpm. The dimensions of the cam plates are as shown in FIG. 4: r1 (radius of base disc part 521A)=45 mm, r2 (radius from rotational center C to distal end of protruding part 522A)=60 mm, r3 (length from distal end of protruding part 522A to through-hole 523A)=15 mm, r4 (diameter of through-hole 523A)=30 mm.

In Working Example 2 as well, articles filled the packages properly twenty continuous times without the articles clogging. Specifically, the article clogging proportion in Working Example 2 was 0% ((0/20)×100) according to the above formula (2).

Comparative Example 1

In the article transfer apparatus according to Comparative Example 1, the cam plate unit 500 used in Working Examples 1 and 2 described above was not included.

In Comparative Example 1, articles were dropped in twenty-five times until the number of times the articles properly filled the packages reached twenty. Specifically, articles were dropped in a total of twenty-five times, during which article clogging occurred five times. Therefore, the article clogging proportion in Comparative Example 1 was 20% ((5/25)×100) according to formula (1) above.

(Conclusion)

In Working Examples 1 and 2, in which the cam plates 520A to 520D enter into the collecting chute 400, there was never any occurrence of article clogging. In Comparative Example 1, however, article clogging occurred at a proportion of 20%. From these results, it can be confirmed that it is possible to resolve article clogging in position P where the inside diameter of the collecting chute 400 is the minimum, by having the cam plates 520A to 520D enter into the collecting chute 400.

The reason for this is believed to be that when the articles have linked together at position P where the inside diameter of the collecting chute 400 is at a minimum, the linked articles are split apart by the cam plates 520A to 520D entering at this position.

<Article Splitting Verification Test>

The following is a description of the test performed in order to confirm the technological effects (article breaking prevention) of the article transfer apparatus 100 according to the embodiment described above. In this test, as Working Example 3, an inspection was performed of the breaking proportion of articles transferred by the article transfer apparatus (the apparatus including the cam plate unit 500) 100 described above. As Comparative Example 2, an inspection was performed of the breaking proportion of articles transferred by an article transfer apparatus having no cam plate unit 500. Aside from the cam plate unit 500, the article transfer apparatus according to Comparative Example 2 is identical to the article transfer apparatus 100 according to Working Example 3.

In Working Example 3 and Comparative Example 2, articles were dropped into the article transfer apparatus from the combining and metering apparatus with 63.3 g as the target weight. The articles here were chips having substantially regular triangle shapes, the length of sides of which were approximately 70 mm, and the thickness of which was approximately 1.5 mm. The minimum inside diameter of the collecting chute in Working Example 3 and Comparative Example 2 was approximately 140 mm.

(Evaluation Method)

The extent of article breaking was visually evaluated in four categories: (1) no breaking, (2) missing tips, (3) missing at least half, and (4) only tips. "(1) No breaking" means that the articles had for the most part retained their shape, "(2) missing tips" means that the tips of the original shapes were missing and that at least half of each article had retained its original shape, "(3) missing at least half" means that at least half of the original shape was missing and at least half of each article had not retained its original shape, and "(4) only tips" means that only the tips of the original shapes were intact.

Working Example 3

In the article transfer apparatus 100 according to Working Example 3, the four cam plates 520A to 520D rotate at phase differences of 90° from each other. The rotational speed of each of the cam plates 520A to 520D is 1000 rpm. The dimensions of the cam plates 520A to 520D are as shown in FIG. 4: r1 (radius of base disc part 521A)=45 mm, r2 (radius from rotational center C to distal end of protruding part 522A)=60 mm, r3 (length from distal end of protruding part 522A to through-hole 523A)=15 mm, r4 (diameter of through-hole 523A)=30 mm. In Working Example 3, the articles were dropped in five times, and article breaking was evaluated each time. The results are as shown in the following Table 1.

TABLE 1

| With Cam Plates | | | | |
|---|---|---|---|---|
| No. | No Breaking | Missing Tips | Missing At Least Half | Only Tips |
| 1 | 16 | 9 | 0 | 14 |
| 2 | 19 | 5 | 3 | 10 |
| 3 | 14 | 10 | 1 | 22 |
| 4 | 19 | 5 | 2 | 18 |
| 5 | 20 | 4 | 3 | 15 |
| Average | 18 | 7 | 2 | 16 |
| Max | 20 | 10 | 3 | 22 |
| Min | 14 | 4 | 0 | 10 |

Comparative Example 2

In the article transfer apparatus according to Comparative Example 2, the cam plate unit 500 used in Working Example 3 described above was not included. In Comparative Example 2, the articles were dropped in five times, and article breaking was evaluated each time. The results are as shown in the following Table 2.

TABLE 2

| Without Cam Plates | | | | |
|---|---|---|---|---|
| No. | No Breaking | Missing Tips | Missing At Least Half | Only Tips |
| 1 | 12 | 6 | 10 | 25 |
| 2 | 13 | 7 | 8 | 27 |
| 3 | 16 | 7 | 4 | 13 |
| 4 | 17 | 9 | 4 | 16 |
| 5 | 16 | 6 | 8 | 12 |
| Average | 15 | 7 | 7 | 19 |
| Max | 17 | 9 | 10 | 27 |
| Min | 12 | 6 | 4 | 12 |

(Breaking Evaluation Results for Working Example 3)

In the test pertaining to Working Example 3 as shown in Table 1, there were 14 to 20 instances of articles evaluated as having "(1) no breaking," and the average of five times was 18. There were 4 to 10 instances of articles evaluated as having "(2) missing tips," and the average of five times was 7. There were 0 to 3 instances of articles evaluated as having "(3) missing at least half," and the average of five times was 2. There were 10 to 22 instances of articles evaluated as having "(4) only tips," and the average of five times was 16.

(Breaking Evaluation Results for Comparative Example 2)

In the test pertaining to Comparative Example 2 as shown in Table 2, there were 12 to 17 instances of articles evaluated as having "(1) no breaking," and the average of five times was 15. There were 6 to 9 instances of articles evaluated as having "(2) missing tips," and the average of five times was 7. There were 4 to 10 instances of articles evaluated as having "(3) missing at least half," and the average of five times was 7. There were 12 to 27 instances of articles evaluated as having "(4) only tips," and the average of five times was 19.

(Conclusion)

Of articles that kept at least half of their original shape, i.e. articles evaluated as having "(1) no breaking" or "(2) missing tips," there was an average of 25 instances in Working Example 3 ((1) no breaking: average 18, (2) missing tips: average 7), and an average of 22 instances in Comparative Example 2 ((1) no breaking: average 15, (2) missing tips: average 7). From these results, it was confirmed that article breaking does not increase even when a plurality of cam plates are capable of entering into the collecting chute as described above.

The reason for this is believed to be that the force from the cam plates 520A to 520D is not readily transmitted to the articles because the falling direction of the articles and the moving direction of the protruding parts 522A, 522B, 522C, 522D of the cam plates 520A to 520D both lead from the top to the bottom, and the falling velocity of the articles and the circumferential velocity of the cam plates 520A to 520D substantially coincide.

Second Embodiment

Next, the article transfer apparatus 100*a* according to the second embodiment will be described with reference to FIGS. 10 and 11. Aside from the changed shape of the cam plate 520*a*, the article transfer apparatus 100*a* according to the second embodiment is identical to the article transfer apparatus 100 according to the first embodiment, and descriptions of components similar to those of the first embodiment are therefore appropriately omitted.

Figure 10:
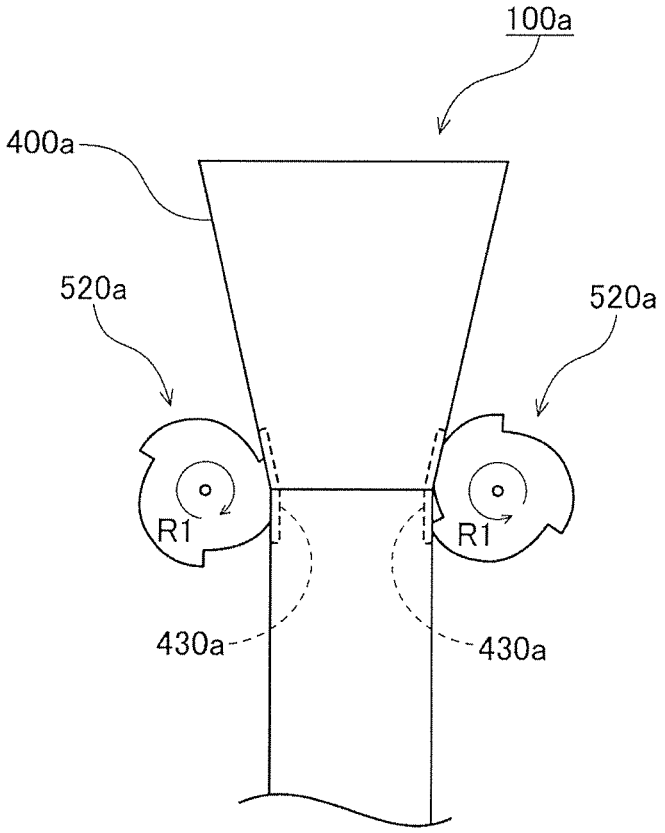
FIG. 10 is a side view of the article transfer apparatus according to the second embodiment of the present invention.
Figure 11:
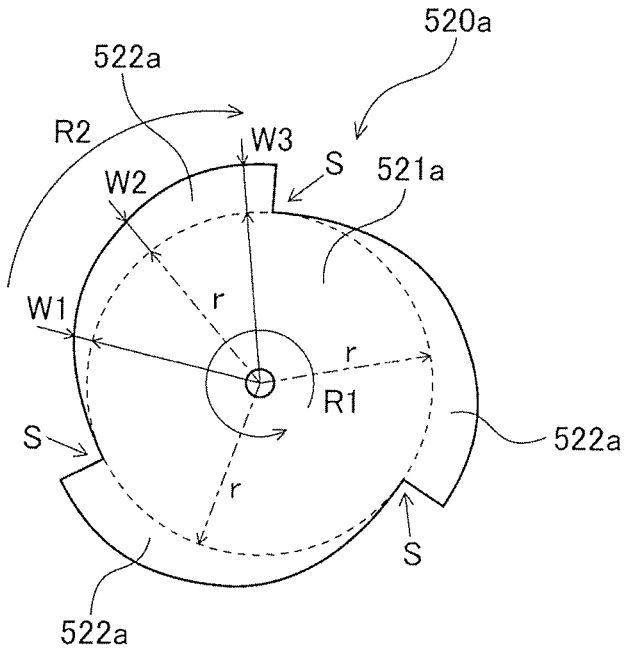
FIG. 11 is a side view of the cam plate according to the second embodiment.

As shown in FIG. 10, the article transfer apparatus 100*a* according to the second embodiment comprises a collecting chute 400*a*, and a cam plate unit (not shown) having a plurality of cam plates 520*a*. The drive parts for driving the plurality of cam plates 520*a* are identical to the motor 510 and the drive parts 530A to 530D of the first embodiment. As in the first embodiment, four cam plates 520*a* are provided. In the present embodiment, each cam plate 520*a* has a base disc part 521*a*, and three protruding parts 522*a* protruding radially outward (in the direction of arrow r) from the external periphery of the base disc part 521*a*, as shown in FIG. 11. As the cam plate 520*a* rotates, the protruding parts 522*a* enter from the outside of the collecting chute 400*a* into the collecting chute 400*a* through a slit 430*a* (see FIG. 10).

In the present embodiment, each of the protruding parts 522*a* protrudes radially outward (in the direction of arrow r) by a greater amount as it progresses along the opposite direction (the direction of arrow R2) of the rotating direction (the direction of arrow R1) of the cam plate 520*a*. Specifically, as shown in FIG. 11, the radial length W1 of the upstream side of the protruding parts 522*a* in the direction of arrow R2, the radial length W2 in the center, and the radial length W3 of the downstream side increase progressively.

The three protruding parts 522*a* described above are provided at approximately 120° intervals along the circumferential direction of the base disc part 521*a* (the direction of either arrow R1 or arrow R2). The protruding parts 522*a* thereby enter into the collecting chute 400*a* three times during one rotation of the cam plate 520*a*.

Effects in Present Embodiment

In the second embodiment described above, due to the amount of radially outward (in the direction of arrow r) protrusion increasing progressively along the opposite direction (the direction of arrow R2) of the rotating direction (the direction of arrow R1) of the cam plate 520*a*, when the protruding parts 522*a* of the cam plate 520*a* enter into the collecting chute 400*a*, the amount by which the protruding parts 522*a* protrude into the collecting chute 400*a* gradually increases as the cam plate 520*a* rotates. This inhibits the articles B from being knocked off by the protruding parts 522*a*.

In the second embodiment, due to three protruding parts 522*a* being formed at 120° intervals along the circumferential direction of the base disc part 521*a*, the three protruding parts 522*a* enter continuously into the collecting chute 400*a* during one rotation of the cam plate 520*a*. It is thereby possible, in a high-speed article transfer apparatus which causes articles B to fall continuously, to cause a protruding part 522*a* to continuously enter into the collecting chute 400*a* every time an article B falls. As a result, the continuously falling articles B are inhibited from becoming clogged within the collecting chute 400*a*.

(Modifications)

Embodiments of the present invention were described above based on the drawings, but the specific configuration is not limited to these embodiments or working examples. The scope of the present invention is presented not only of the above descriptions of the embodiments and working examples but in the Patent Claims as well, and included therein are meanings equivalent to the Patent Claims and all variations within this scope.

<First Modification>

Figure 6:
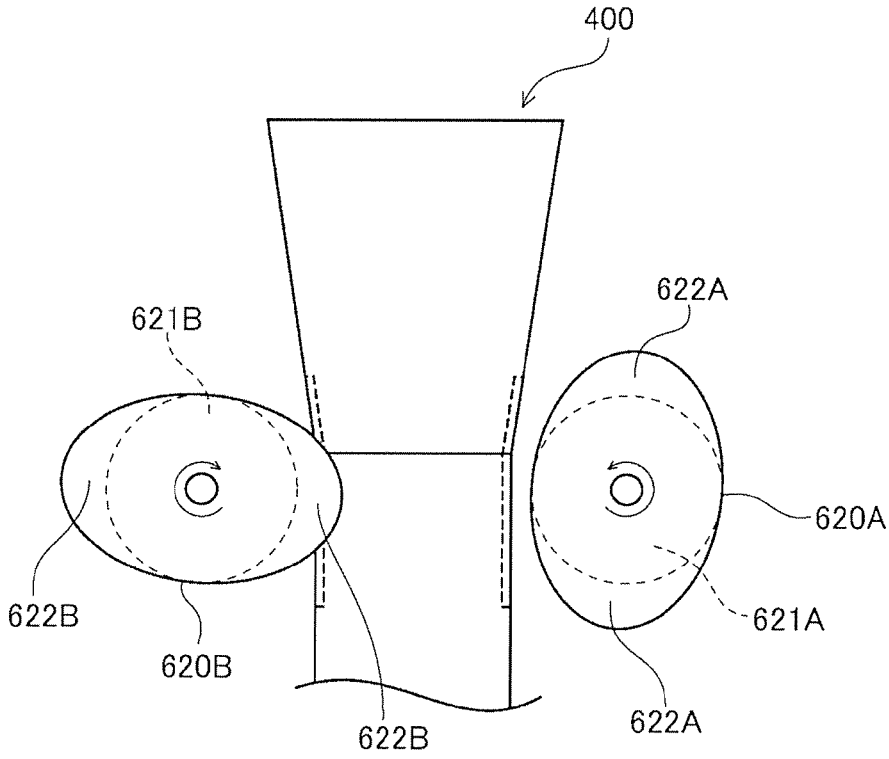
FIG. 6 is a side view of the article transfer apparatus according to the first modification of the present invention.

For example, in the first embodiment described above, an example was described in which a cam plate 520A was used having a base disc part 521A and protruding parts 522A, but the present invention is not limited to this example, and it is also possible to use the cam plates 620A and 620B according to the first modification shown in FIG. 6. The cam plate 620A, which is substantially elliptical, has a substantially circular plate-shaped base disc part 621A and two protruding parts 622A which extend radially outward from the external periphery of the base disc part 621A. The protruding parts 622A are disposed opposite each other, the center of the cam plate 620A in between them. The cam plate 620B is identical to the cam plate 620A, and a description thereof is omitted. The cam plates 620A and 620B according to the first modification are provided opposite each other with the collecting chute 400 in between them, and the cam plates 620A and 620B rotate at a phase difference of 180° from each other. The protruding parts 622A of the cam plate 620A and the protruding parts 622B of the cam plate 620B enter into the collecting chute 400 in an alternating manner.

<Second Modification>

Figure 7:
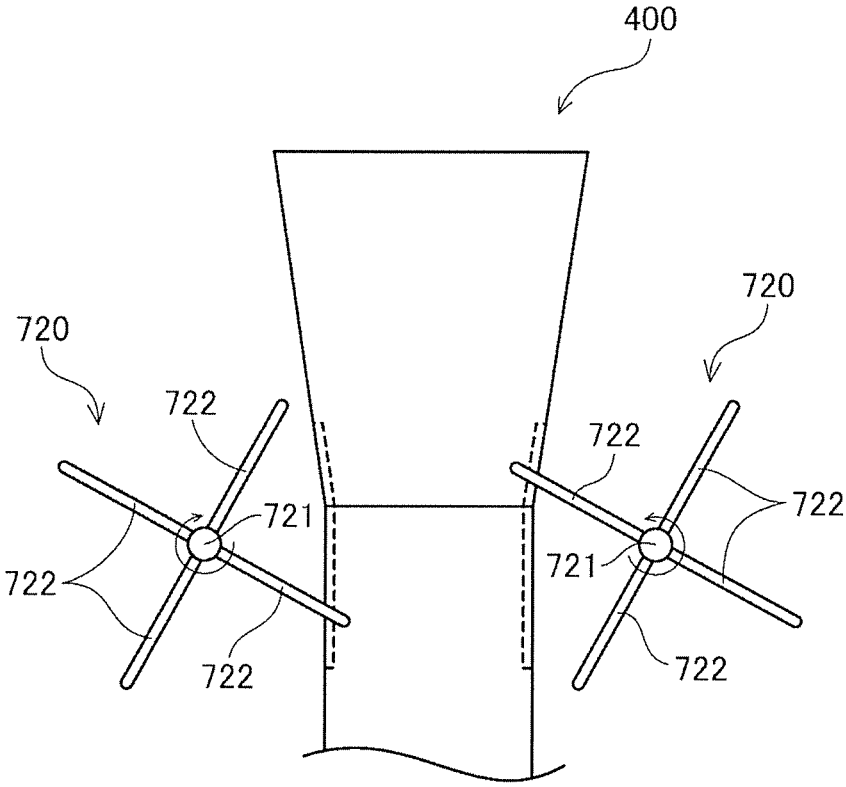
FIG. 7 is a side view of the article transfer apparatus according to the second modification of the present invention.

In the first and second embodiments described above, an example was described in which the first through fourth cam plates 520A to 520D and the cam plates 520*a* were used as examples of the clogging prevention members, but the present invention is not limited to this example, and the clogging prevention members 720 according to the second modification shown in FIG. 7 can also be used. Each of these clogging prevention members 720 has a rotating shaft 721 and rod members 722 extending radially outward from the rotating shaft 721. For these rod members 722, highly rigid members can be used, or members that flexibly deform can be used.

<Third Modification>

Figure 8A:
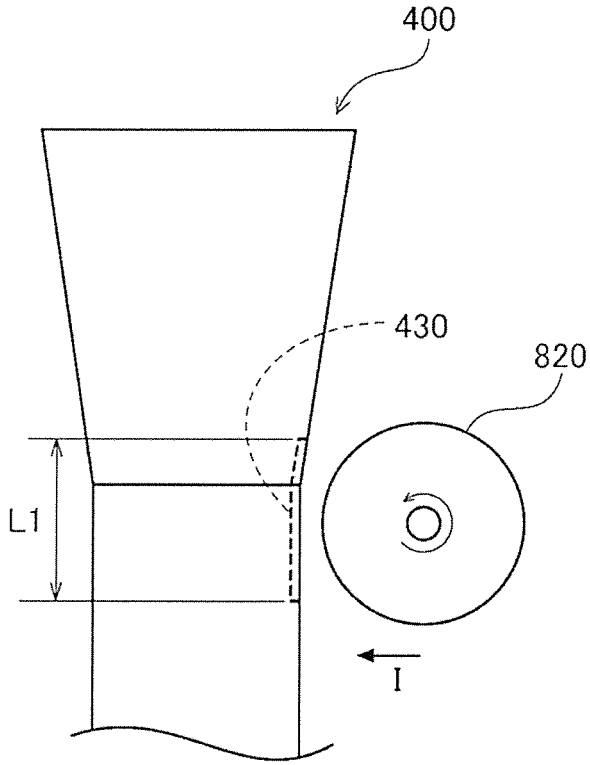
FIG. 8 is a side view of the article transfer apparatus according to the third modification of the present invention.
Figure 8B:
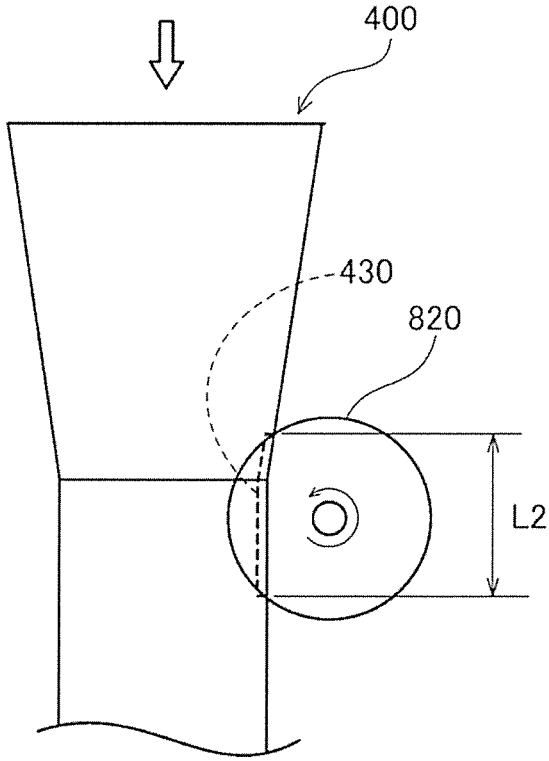

In the first and second embodiments described above, an example was described in which the first through fourth cam plates 520A to 520D and the cam plates 520*a* were used as examples of the clogging prevention members, but the present invention is not limited to this example, and the clogging prevention member 820 according to the third modification shown in FIG. 8 can also be used. This clogging prevention member 820, which has a circular plate shape, moves toward the inside of the collecting chute 400 (in the direction of arrow I). The clogging prevention member 820 according to the third modification has a length L2 in the position where a slit is formed when part of the member has entered into the collecting chute 400 (see FIG. 8(*b*)), the length L2 being substantially equal to the vertical length L1 of the slit.

The slit 430 can thereby be closed off along the vertical direction by the clogging prevention member 820 entering into the collecting chute 400. This inhibits articles B from spilling out of the collecting chute 400 from the interior.

<Fourth Modification>

Figure 9:
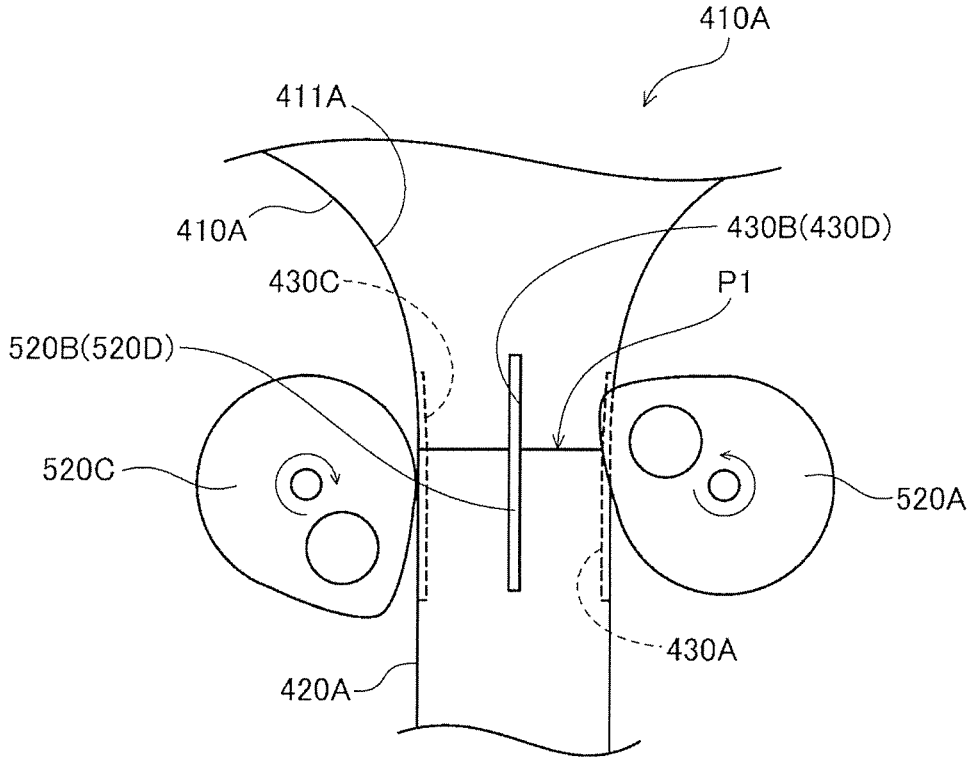
FIG. 9 is a side view of the collecting chute of the article transfer apparatus according to the fourth modification of the present invention.

In the first embodiment described above, an example was described which used a collecting chute 400 having a narrowing portion 410 where the inside diameter decreased from the top to the bottom and a straight portion 420 extending downward from the bottom end of the narrowing portion 410, but the present invention is not limited to this example, and the collecting chute 400A according to the fourth modification shown in FIG. 9 can also be used. The collecting chute 400A according to the fourth modification has a narrowing portion 410A where the inside diameter decreased from the top to the bottom, and a straight portion 420A extending downward from the bottom end of the narrowing portion 410A. Unlike the narrowing portion 410 whose inside wall surface inclines in a straight line, the inside wall surface 411A of the narrowing portion 410A inclines in a curve. The cam plates 520A to 520D herein are disposed at a position P1 where the inside diameter of the collecting chute 400A is at a minimum. This position P1 is the position where the narrowing portion 410A and the straight portion 420A connect, and is also a position which leads from the narrowing portion 410A whose incline continuously changes to the straight portion 420A where the change in incline becomes constant.

<Fifth Modification>

In the embodiments described above, an example was described in which the circumferential velocity V2 of the protruding parts 522A was greater than the falling velocity (approximately 4.5 [m/s]), but the present invention is not limited to this example, and the circumferential velocity V2 of the protruding parts 522A can also be less than the falling velocity. In this case, since the circumferential velocity V2 of the protruding parts 522A is less than the falling velocity of the articles B at position P, the protruding parts 522A operate when the articles B become clogged at position P, and the clogging of articles B can be resolved.

<Sixth Modification>

In the first embodiment described above, an example was described in which the cam plates 520A to 520D enter into the collecting chute 400 with different timings, but the present invention is not limited to this example, and the cam plates 520A to 520D can be made to enter into the collecting chute 400 at the same time. In cases in which the collecting chute 400 has a small inside diameter, when a plurality of cam plates 520A to 520D enter into the collecting chute 400 at the same time, the effective cross-sectional area becomes extremely small and there is a risk of the articles B becoming clogged, but in cases in which the collecting chute 400 has a large inside diameter, having the cam plates 520A to 520D enter into the collecting chute 400 at the same time causes the inside diameter of the collecting chute 400 to increase and decrease intermittently, and the articles B can therefore be reliably conveyed downward.

<Seventh Modification>

Figure 12:
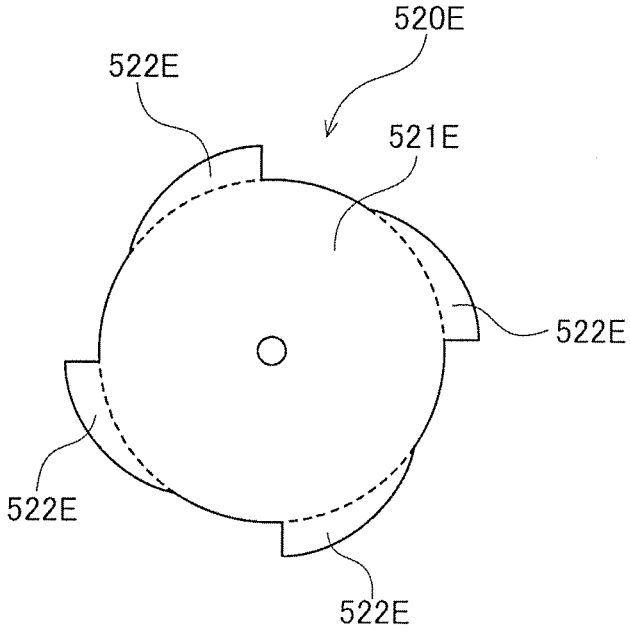
FIG. 12 is a side view of the cam plate according to a modification of the second embodiment.

In the second embodiment described above, an example was described in which three protruding parts 522*a* are provided to the external periphery of the base disc part 521*a*, but the present invention is not limited to this example, and it is also possible to form either four or more or two or fewer protruding parts. As an example, the cam plate 520E according to the modification shown in FIG. 12 has a base disc part 521E and four protruding parts 522E in the external periphery of this base disc part 521E. These four protruding parts 522E are provided at 90° intervals around the external periphery of the base disc part 521E.

<Eighth Modification>

Figure 13:
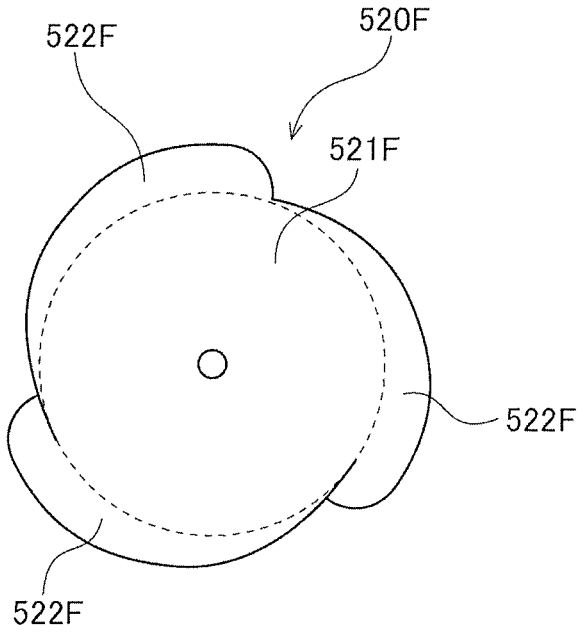
FIG. 13 is a side view of the cam plate according to a modification of the second embodiment.

In the second embodiment described above, the connecting portions S (see FIG. 11) between the protruding parts 522*a* and the base disc part 521*a* are corners, in which there is a possibility of the articles B becoming clogged. In view of this, in the cam plate 520F according to the modification shown in FIG. 13, the protruding parts 522F and the base disc part 521F connect smoothly together so that the aforementioned corners are not formed.

REFERENCE SIGNS LIST

| | |
|---|---|
| 100, 100a | article transfer apparatus |
| 200 | combining and metering apparatus |
| 300 | packaging apparatus |
| 400, 400a, 400A | collecting chute |
| 520A-F, 520a, 620A, 620B | cam plate |
| 530A-530D, 430a | slit |
| 521A-521F, 521a, 621A, 621B | bas disc part |
| 522A-522F, 522a, 622A, 622B | protruding part |
| 720, 820 | clogging prevention member |

The invention claimed is:

1. An article transfer apparatus for transferring articles downward which fall from above, comprising:

a cylindrical chute extending vertically;

a slit formed in a side wall surface of the chute; and a clogging prevention member rotatably supported adjacent to the chute, the clogging prevention member being configured and arranged to periodically enter the chute through the slit from an exterior of the chute while the clogging prevention member is rotating.

2. The article transfer apparatus according to claim 1, wherein a plurality of the clogging prevention members are provided adjacent to the chute; and the clogging prevention members are configured to enter the chute at staggered intervals relative to one another.

3. The article transfer apparatus according to claim 2, wherein the plurality of the clogging prevention members are disposed at equal intervals around an outer periphery of the chute and are configured to rotate with a phase difference of equal intervals relative to one another.

4. The article transfer apparatus according to claim 1, wherein a plurality of the clogging prevention members are provided adjacent to the chute; and the clogging prevention members are configured to enter the chute simultaneously.

5. The article transfer apparatus according to claim 1, wherein the clogging prevention member includes a circular plate part and a protruding part which protrudes radially outward from an external periphery of the circular plate part; and the protruding part is dimensioned to enter into the chute through the slit from the outer side of the chute in response to rotation of the clogging prevention member.

6. The article transfer apparatus according to claim 5, wherein the protruding part protrudes radially outward from the circular plate part by an amount that increases in a circumferential direction that is opposite the direction in which each of the clogging prevention members rotates.

7. The article transfer apparatus according to claim 5, wherein the clogging prevention member has a plurality of protruding parts; and the protruding parts are formed at predetermined intervals along the circumferential direction of the circular plate part.

8. The article transfer apparatus according to claim 1, wherein the clogging prevention member is either a plate-shaped member having a thickness equal to the width of the slit, or a plate-shaped member having a thickness less than the width of the slit.

9. The article transfer apparatus according to claim 1, further comprising:

a controller for controlling the rotation of the clogging prevention member so as to reach a rotation rate determined based on the falling velocity of the articles in the position where the inside diameter of the chute reaches a minimum.

10. The article transfer apparatus according to claim 2, wherein each of the clogging prevention members includes a circular plate part and a protruding part which protrudes radially outward from an external periphery of the circular plate part; and each of the protruding parts is dimensioned to enter into the chute through the slit from the outer side of the chute in response to rotation of the clogging prevention member.

11. The article transfer apparatus according to claim 10, wherein each of the protruding part protrudes radially outward from the circular plate part by an amount that increases in a circumferential direction that is opposite the direction in which each of the clogging prevention members rotates.

12. The article transfer apparatus according to claim 10, wherein each of the clogging prevention members has a plurality of protruding parts; and the protruding parts are formed at predetermined intervals along the circumferential direction of the circular plate part.

13. The article transfer apparatus according to claim 2, wherein each of the clogging prevention members is either a plate-shaped member having a thickness equal to the width of the slit, or a plate-shaped member having a thickness less than the width of the slit.

14. The article transfer apparatus according to claim 2, further comprising:

a controller for controlling the rotation of the clogging prevention members so as to reach a rotation rate determined based on the falling velocity of the articles in the position where the inside diameter of the chute reaches a minimum.

* * * * *